United States Patent [19]

Roth

[11] Patent Number: 4,590,685

[45] Date of Patent: May 27, 1986

[54] METHOD & APPARATUS FOR UNIFORMLY DRYING PAPER WEBS AND THE LIKE

[76] Inventor: Reinhold C. Roth, 27 Chastellux Ave., Newport, R.I. 02840

[21] Appl. No.: 670,335

[22] Filed: Nov. 9, 1984

[51] Int. Cl.[4] ..... F26B 21/10

[52] U.S. Cl. ..... 34/31; 34/41; 34/44; 34/48; 34/53

[58] Field of Search ..... 432/8, 37, 55, 59, 12, 432/354; 34/48, 41, 44, 53, 31, 34

[56] References Cited

U.S. PATENT DOCUMENTS 3,089,252 5/1963 Daane et al. ..... 34/114

4,498,864 2/1985 Roth et al. ..... 432/8

*Primary Examiner*—Larry I. Schwartz

*Attorney, Agent, or Firm*—Louis Weinstein

[57] ABSTRACT

Method and apparatus for uniformly drying a web to obtain a desired moisture content within a predetermined tolerance. A matrix of emitters arranged in m rows and n columns (where m,n≧2) are operated at either low or high flame conditions. At least one emitter in each column is operated in a duty cycle fashion wherein the said emitter is maintained at the high flame condition for a predetermined portion of the duty cycle and at the low flame condition for the remainder of the duty cycle as a function of the amount of drying desired. This technique yields a finer adjustment than is capable in conventional systems. The high flame condition is selected to operate the emitters at a radiant energy whose wavelength optimizes the drying capability. Air circulators enhance the drying operation and protects the system from damage. Sprayers spray the emitters to prevent damage due to overheating when a web break occurs.

17 Claims, 13 Drawing Figures

| DUTY CYCLE ON | OFF |
|---|---|
| 6 | 0 |
| 5 | 1 |
| 4 | 2 |
| 3 | 3 |
| 2 | 4 |
| 1 | 5 |

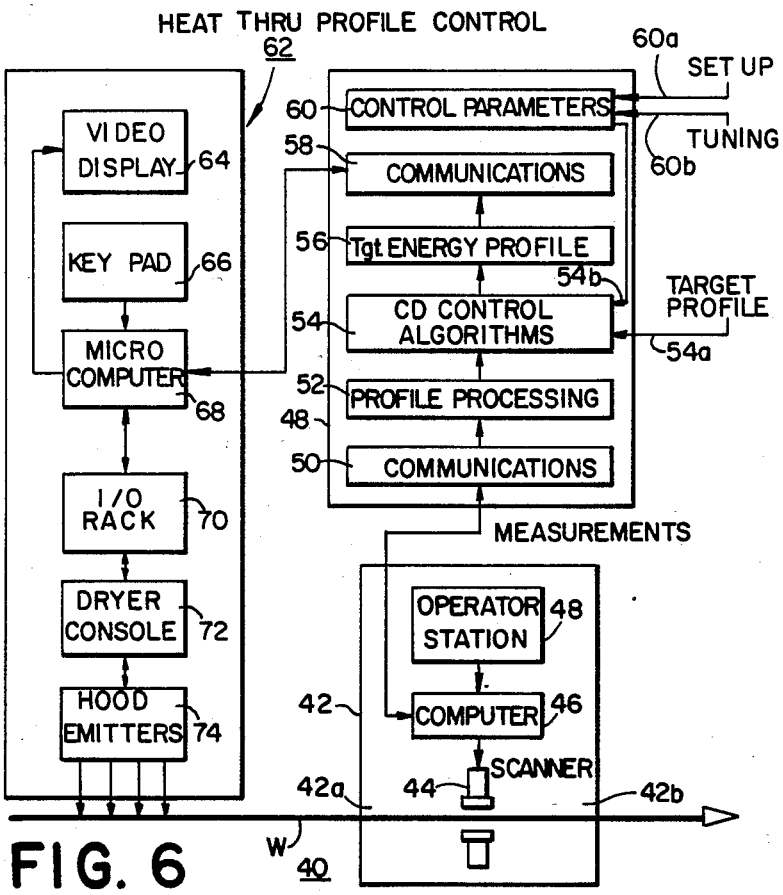
FIG. 6
FIG. 7
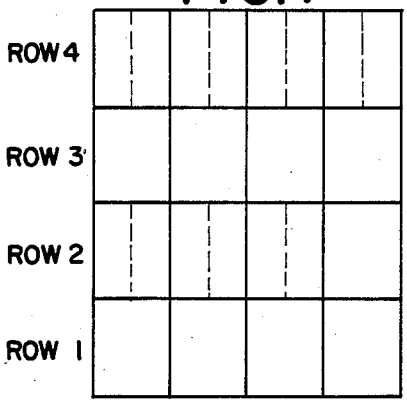
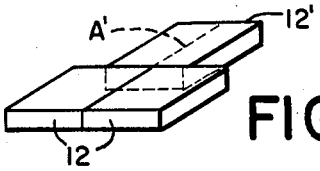
FIG. 7a
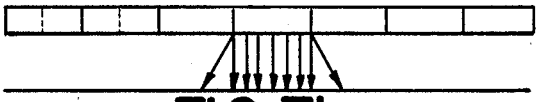
FIG. 7b
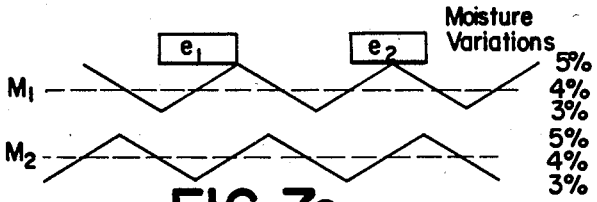
FIG. 7c

METHOD & APPARATUS FOR UNIFORMLY DRYING PAPER WEBS AND THE LIKE

FIELD OF THE INVENTION

The present invention relates to Apparatus for controlling the drying of a paper web to obtain uniform drying in the cross direction of the web and to provide a drying operation which is fuel efficient. A plurality of drying units are provided, each drying unit comprising a plurality of radiant energy emitters arranged across the web, and each having its own regulator the rate of fuel consumption between a high and low frame level. The controller controls the required period of time during a preset duty-cycle that the emitter is operated in the high flame state as a function of the moisture content correction. The high flame condition is selected to maximize penetration of the web by the radiation generated by the emitters. The controller responds either to a manual input or sensor means which senses moisture content of the moving web, providing an input to the controller. Alternating rows of emitters may be staggered with interspersed rows of emitters to provide greater resolution of drying energy in the cross direction of the web.

BACKGROUND OF THE INVENTION

The present invention relates to method and apparatus for drying webs and more particularly a novel method and apparatus in which a plurality of spaced parallel drying units, each having a plurality of drying emitters arranged in the cross direction of the web are operated at either a low flame or high flame state for a varying length of time within a preset duty cycle to adjust the moisture content of the web and further to provide a uniform moisture content across the web.

A paper web produced during a papermaking operation undergoes drying during the final production stage and prior to being wound upon a supply reel. Due the limitations in paper drying equipment as well as local conditions, non-uniform moisture content in the cross web direction as well as deviations in the desired moisture content are typically encountered.

One conventional technique for correcting deviations from the desired moisture content comprises the utilization of a dryer unit whose drying energy output is varies in a direct proportion to the deviation of moisture content of the web from the desired value. The disadvantages in the use of this technique reside in the fact that the valuable properties of infrared energy deteriorate drastically with a decrease in temperature. This effects energy efficiency, penetration of the radiant energy into the web, absorbtion of energy, and a unique property of increased absorbtion in higher moisture regions of the web at a specific wavelength or temperature. In addition, the ability of the radiation energy to penetrate the web varies as a function of the energy output. One technique for improving uniformity of moisture content in the cross web direction utilizes a plurality of individual emitters which are selectively operated in accordance with the moisture content of the portion of the web passing the associated emitter. One preferred embodiment of this technique is set forth in U.S. Application Ser. No. 448,619, filed Dec. 10, 1982, by the Assignee of the present invention, now U.S. Pat. No. 4,498,864 issued Feb. 12, 1985. The technique described in the aforementioned issued Patent, however, is not capable of making fine adjustments in moisture content.

BRIEF DESCRIPTION OF THE INVENTION

The present invention overcomes the disadvantages of the prior art through the use of a technique characterized by comprising the novel control of a plurality of drying units. Each drying unit includes a plurality of individual emitter units running in the direction transverse to movement of the web. The dryer units are arranged in spaced parallel fashion. The air/gas mixture provided at each emitter is selected to cause the emitter to operate at either a high or a low flame condition. At the high flame condition, the emitter emits infrared radiation whose penetration of the web is maximized. The low flame condition generates an insignificant amount of radiation energy for drying purposes but is sufficient to sustain combustion.

Each emitter is individually by a controller. Very fine adjustments in the reduction of moisture content are obtained in the following manner:

A preset duty cycle, for example in the range from five to ten seconds, is established. The period of time during each duty cycle that the emitter is operated at the high flame and at the low flame is varied in accordance with the amount of drying desired. In one preferred embodiment, during a six second duty cycle, drying may be regulated in small increments of the maximum drying capability by controlling the fraction of time that the emitter is in the high flame condition in very small time increments. For the example, in which four drying units are employed and only one of the units is operated using the duty cycle technique, while the remaining three units are operated at either high or low flame condition, drying can be controlled in steps of 1% of the maximum drying capability.

The ability to resolve narrow moisture streaks in the cross web direction is further enhanced by staggering emitter units in alternating rows of drying units relative to the interspersed rows or drying units and operating all of the emitters in the drying units in such a manner as to enhance the drying capability over much smaller sections of the paper web than are capable of being dried through the use of standard size emitters and without the need for reducing emitter size.

OBJECTS OF THE INVENTION AND BRIEF DESCRIPTION OF THE FIGURES

It is, therefore, one primary object of the present invention to significantly increase the degree of the drying of a paper web by controlling the operation of selected ones of the emitters used for drying to regulate the time in each cycle during which the emitter is at high or low flame in accordance with the amount of drying desired.

Still another object of the present invention is to provide a method and apparatus for controlling the drying of a web to provide uniform drying across the web and to adjust deviations from a desired moisture target wherein the emitters are operated at either low or high flame, and at the same time maximize the number of emitters that are operated in the high flame conditions to optimize moisture streak reduction.

Still another object of the present invention is to provide a novel arrangement for increasing the drying resolution across the web by arranging the emitters used for drying in alternating rows of drying units staggered relative to the emitters in the remaining rows of drying units.

The above as well as other objects of the present invention will become apparent when reading the accompanying description and drawing in which:

FIG. 1(*a*) shows a simplified diagram of a matrix arrangement of emitters utilized in the present invention.

FIG. 1(*b*) shows a portion of a conventional dryer arrangement.

FIGS. 1(*c*) and 1(*d*) show the energy distributions for the dryer arrangements of FIGS. 1(*a*) and 1(*b*), respectively.

FIG. 6 is a block diagram showing the apparatus employed for controlling the emitters of FIG. 1, for example.

FIG. 7 is a top plan view showing another preferred embodiment for the emitter arrangement of the present invention.

FIG. 7(*a*) is a simplified perspective view showing the staggered emitter arrangement of FIG. 7 in greater detail.

FIG. 7(*b*) shows an elevational view of the emitters arranged in one row of the overlapped emitter arrangement of FIGS. 7 and 7(*a*).

FIG. 7(*c*) shows a portion of the emitter arrangement of FIG. 7, together with waveform diagrams which are useful in explaining the advantage of the overlapped emitter arrangement.

DETAILED DESCRIPTION OF THE INVENTION AND THE PREFERRED EMBODIMENTS THEREOF

The major objectives of the present invention are to maintain the moisture content of a web being dried within a tolerance range on either side of a desired value (target) which range is a fraction of a percent and further to obtain a substantially uniform moisture content in the cross direction of the web.

Considering FIGS. 1(*a*) and 1(*b*), the web being dried moves beneath the dryer units in the direction shown by arrow 10 (see FIG. 1(*b*)). The web is a substantially flat planar web of indeterminate length and moves in the plane of FIG. 1(*a*).

The emitters 12 in FIG. 1(*a*) are arranged in a plurality of rows, the number of emitters per row being a function of the length of an emitter measured in the cross web direction and the width of the web being dried. Arrow 20 represents the cross web direction. For example, in one particular embodiment, emitters having a six inch (6″) length in the cross web direction are utilized. The total number of emitters is then a function of the width of the web. For example, eight such emitters are utilized for drying a 48″ wide web.

The present invention may use the emitters of the type described in copending Application Ser. No. 448,619, filed Dec. 10, 1982, now U.S. Pat. No. 4,498,864, issued Feb. 12, 1985, the teachings of this Patent being incorporated by reference herein. The emitters as shown for example in FIGS. 7 through 7(*b*) of the aforementioned Patent each utilize a valve arrangement moveable under control of the controller to be described here and below, for maintaining either a low flame or a high flame condition by adjustment of the air/gas mixture delivered to each emitter. The low flame condition utilizes the lowest fuel flow necessary to maintain combustion in the emitter and, in the preferred embodiment is less than 700 degrees centigrade (700° C.).

Figure 4:
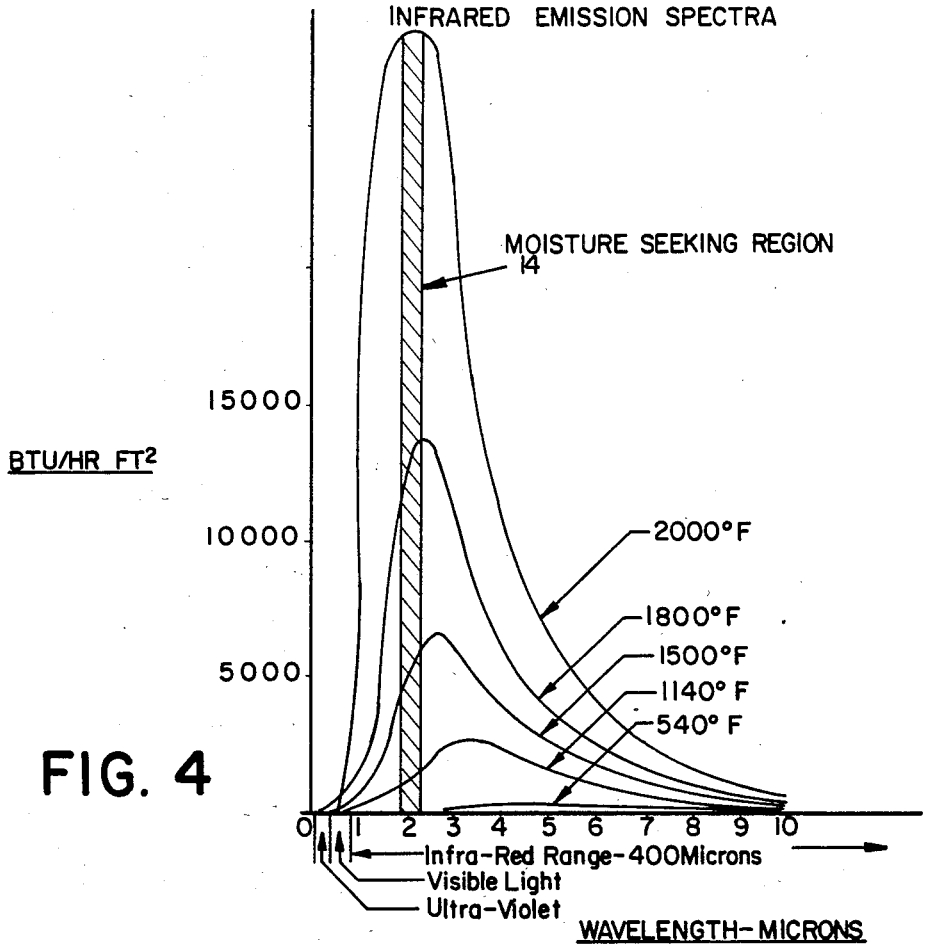
FIGS. 4 and 5 are waveform diagrams showing the drying capability and web penetration capability of the emitters of the present invention, and which are useful in explaining the manner in which these values are adjusted to yield optimum results.

The air/gas mixture is adjusted in the high flame position to maintain a temperature of the order of 1100 degrees centigrade (1100° C.). The emitter radiates energy in the infrared range whose nominal wave length is preferably between 1.85 and 2.05 microns with a preferred range of 1.9 to 1.95 microns. Radiant energy in this wavelength range has the unique property of being absorbed more readily in high moisture regions as opposed to low moisture regions and can reduce moisture variation by as much as 50% at the reel. FIG. 4 shows a plot of the infrared emission spectra wherein the drying capability measured in BTU's per square foot per hour is compared against the infrared wave length range, with each curve representing a different operating temperature. At a temperature of 2,000° F. (which is approximately 1100° C.) drying capability is optimized at a wavelength range between approximately 1.85 and 2.05 microns, as represented by the moisture seeking region 14.

Figure 5:
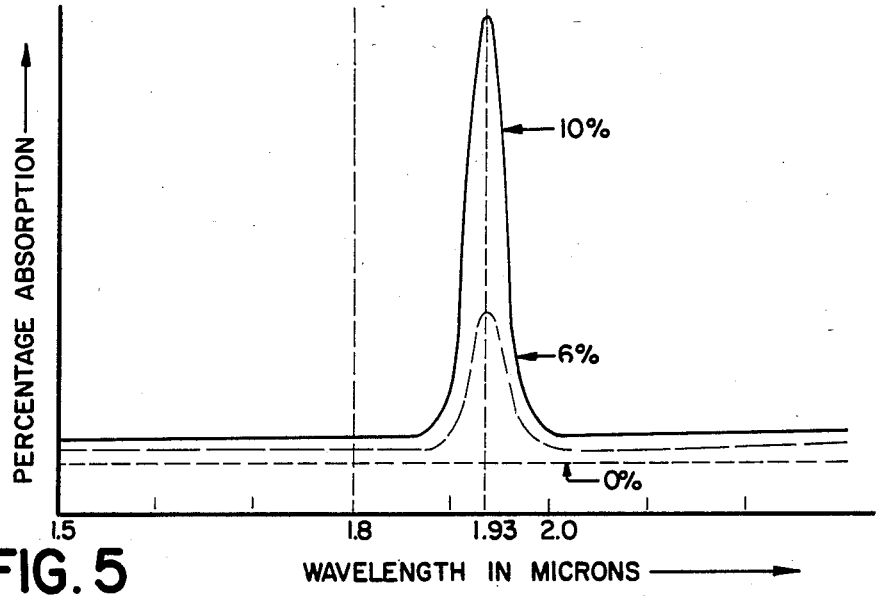

The waveforms in FIG. 5 represent the penetration of infrared radiation into the web in which the percentage absorption is plotted as a function of wavelength for the radiation for webs having three different moisture contents namely 0 percent, 6 percent and 10 percent. A consideration of the waveforms in FIG. 5 clearly indicate that the penetration capability increases as a function of moisture content and that the penetration capability is maximized for radiant energy at a wavelength of 1.93 microns.

The valve structures for the emitters may be operated in either the high or low flame position in one of two modes, i.e. discretely in either the high or low flame or operated in a "duty cycle" which repeatedly cycles the metering valve between high and low flame with the fraction of time in the duty cycle at the high flame with determining the level of intensity (i.e. temperature level) of the emitter.

This can be described as:

$$T_h/(T_l+T_h)$$

Where $T_h$ is the time in seconds that the valve is maintained in the position to provide the high flame condition and $T_l$ is the time in seconds that the valve is maintained in the position to provide the low flame condition. The duty cycle preferably has a length in the range from 5 to 10 seconds, and is continuously repeated.

Figure 1A:
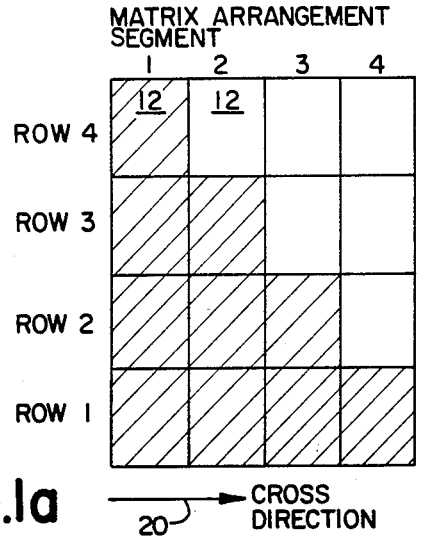
Figure 1B:
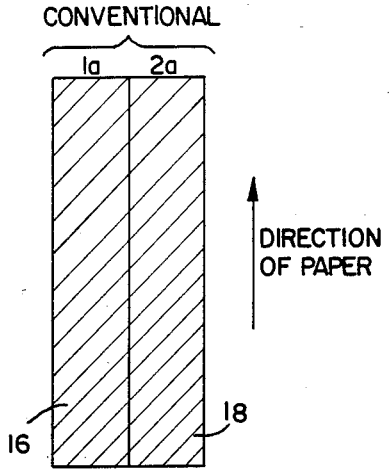
Figure 1C:
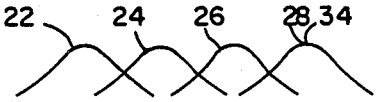
Figure 1C:
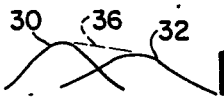
Figure 2:
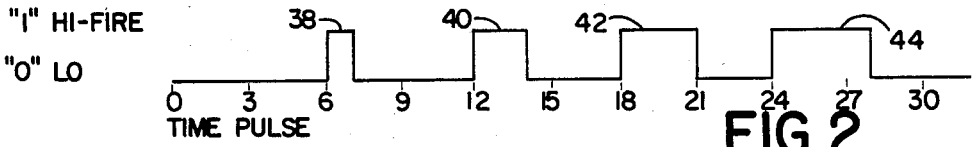
FIG. 2 is a waveform diagram showing the high flame/low flame dryer variations obtainable through the apparatus of the present invention.

The advantages of the matrix arrangement and the advantages obtained through a duty cycle will now be explained making reference to FIGS. 1(*a*) through 1(*d*) and FIG. 2.

FIG. 1(*a*) shows a matrix arrangement in which four rows of emitters are provided with four emitters (12) arranged in each row. Those emitters whose blocks are shown cross-hatched are operated at the high flame condition while those emitters whose blocks are not cross-hatched are operated at the low flame condition.

FIG. 1(*b*) shows a conventional dryer arrangement in which two long columns of dryer 16 and 18 are provided. The conventional dryer unit 16 in column 1(*a*) is cross-hatched with a cross-hatching of greater density than the cross-hatching of conventional dryer unit 18 to indicate operation at a higher temperature than the operating temperature of dryer unit 18. The conventional dryer approach is to furnish one long continuous segment i.e. dryer unit 16 and dryer unit 18 as contrasted with the modular approach in which each segment or column is comprised of four separate emitter units. Comparing the Segment 1 dryer units 12 in Rows 1 through 4 with conventional unit 16, there is no difference in drying capability. All Segment 1 emitter units 12 in Rows 1 through 4 are "on" while the entire dryer unit 16 in column 1(*a*) is also operated at full fire. The resulting energy distributions in the cross direction are shown by the waveforms in FIGS. 1(*c*) and 1(*d*) wherein waveforms 22, 24, 26 and 28 represent the energy distribution for the Segment 1 through 4 emitters respectively. Waveforms 30 and 32 represent the energy distributions for the conventional dryer units 16 and 18. From a consideration of the energy distribution waveforms, it can be seen that there is an overlap of energy into adjacent sections. However, the overlap is uniform on both sides so that the resulting level of energy is substantially uniform across the entire sheet when all of the emitter units of the segments are in full fire. Thus, dotted waveform 34 represents the energy distribution which is a result of the summation of the individual energy distributions represented by waveforms 22 through 28. Conversely, the dotted waveform 36 represents a summation of the energy distributions of eaveforms 30 and 32.

When the conventional system comprised of dryer 16 and 18 is turned on to a level of twenty-five percent (25%) of the full flame condition this represents a drop in temperature from 1100° C. to 800° C. Waveform 30 represents the full flame condition (1100° C.) while waveform 32 represents the reduced flame condition (800° C.). It can be seen that the resulting energy distribution for dryer 18, in addition to having a lower maximum value, is significantly wider due to the fact that the lower temperature alters the radiation pattern and also reduces the penetration of the radiant energy into the paper due to reflection and surface effects. The total result therefore is that when the temperature is lower in a given segment the radiant energy imparted into the paper in that region is dispersed over a significantly larger area and overlaps deeper into the adjacent heating zones making controls very difficult due to the fact that, as the temperature is changing a different overlap must be taken into account in the selection of the proper energy level for each segment across the paper web to properly correct for moisture variations in the cross-direction of the web as the paper is being made.

Using the matrix approach of FIG. 1(*a*), wherein each individual modular emitter unit 12 is operated either "on" or "off", i.e. at high or low flame, it is possible to precisely turn down the energy from 100% to 0% in increments of 25% for a four row system, for example. The benefit of this approach is that the energy distribution does not change since the temperature of each module is always the same. Even if the total amount of energy is reduced, the distribution of the energy level selected will always be the same, making it possible to establish a control algorithm that properly takes into account the effect of overlapping energy in the calculation of the most optimal setting for each particular emitter segment. It is thus possible to adjust the amount of drying between 0% and 100% of maximum capacity in twenty-five increments by controlling the number of emitter segments which are in high flame. In the embodiment shown in FIG. 1(*a*), 100% drying is obtained through the emitters 12 of Segment 1, all of which are "on"; 75% drying is obtained from the emitters of Segment 2, only three of which are at high flame. 50% drying and 25% drying are respectively obtained from the Segment 3 and Segment 4 groups of emitters 12 in a similar manner, as shown in FIG. 1. Thus, comparing this arrangement with the conventional arrangement, the radiant energy from emitter units which are at high flame provide maximum web penetration and optimum drying capability.

In order to greatly enhance the resolution in the matrix operation and in order to achieve a finer level of adjustment while utilizing the technique in which the emitters are at either the high or low flame levels described herein and above, a precise duty cycle is selected, such as six seconds, for example. Noting FIG. 2, for a six second duty cycle, there is shown the possible selections of operation. It is assumed that instead of turning each emitter unit completely off, it is turned down to a temperature which is sufficient to maintain flame and integrity but not sufficient to actually evaporate water in the paper.

The first time pulse between 0 and 6 seconds indicates that the emitter is operating continuously at low fire, the entire 6 second pulse being at the low fire level. The next pulse i.e. between 6 and 12 seconds indicates an increase in the surface temperature of the emitter by operating the emitter at the high fire pulse during only the first second of the 6 second duty cycle, as represented by pulse 38. During the third duty cycle i.e. between 12 and 18 seconds, the emitter is obtained at high flame for 2 seconds as represented by pulse 40.

In a similar manner, during the period from 18 to 24 seconds and from 24 to 30 seconds, the emitter is obtained at high flame for 3 seconds and 4 seconds respectively as represented by time pulses 42 and 44. Five and six second high flame conditions may be obtained in a similar fashion. Once a particular duty cycle is chosen; it is successively repeated in a continuous fashion during a drying operation.

The thermal inertia of the emitters employed in the system of the present invention hold surface temperatures to plus or minus one degree centigrade (±1° C.) of the desired level. The advantages of the system described here and above are as follows:

I. Comparing the continuous control technique to the "duty cycle" exerted over all emitters in a given cross-direction segment leads to substantial fuel savings. The savings are typically expressed so $$\frac{(E1 - Eo)}{Eo}(1 - 1/N)$$

Where El is the average increase in fuel consumption for a given application which normally consumes a level Eo of energy. The term: (El-Eo)/Eo represents the percentage increase. Typically this term is 0.20 or 20%. N represents the number of rows in a system. The savings for a four row system therefore is 0.20 (1−1/N) or $\frac{3}{4}$ (0.20)=15%.

II. Since the units that are "on" are operated in the high flame condition there is more energy in the (1.85–2.05) micron wavelength region. As was described here and above, the energy of this wavelength has the unique property of being absorbed more readily in high moisture regions than in low moisture regions and can correct high frequency moisture variations by as much as 50% at the reel, i.e. the reel upon which the web is wound after drying.

III. There is improved geometric energy distribution across the emitter. A reduced emitter temperature moves the mean of the emitter wavelength spectrum toward a higher wave length. There is greater dispersion in the emitter wavelength spectrum about the main value causing a less homogeneous wavelength or temperature distribution. The wider horizontal distribution also disperses the geometry of the physical energy distribution, changing the degree of coupling and therefore the cross direction control algorithm is no longer valid.

By limiting the duty cycle control to only one emitter in each segment rather than controlling all emitters, better accuracy and repeatability is obtained since the operation at each value within the duty cycle is precisely timed to measure an accurate amount of gas/air flow. Subjecting only one emitter in each segment to duty cycling at a time significantly reduces the wear of these valves. thus by operating only a single row of emitter units, repeatability is enhanced without any reduction in the fine adjustment of the heating level. For example, all of the emitter units in Row 4 may be controlled to operate at any of the desired duty cycle values shown in FIG. 2 while the emitter units in Rows 1 through 3 are either at high or low flame levels. Operating in this manner, twenty-four discrete steps of heating adjustment are obtainable while operating the emitter units of only Row 4 to obtain the desired duty cycle selections. Although, in the example given the emitter units in Row 4 are controlled to obtain any one of the combinations of operation throughout the total number of duty cycle combinations, it is preferable to alter the emitter used for the duly cycle continuously from Row 1–4.

Further advantages include:

IV. Longer cylinder life and less wear of the operating valves controlling the air/gas mixture;

V. Higher resolution—more adjustment steps per emitter;

VI. More uniform temperature and energy distribution in a given cross-direction location compared with the duty cycle control of all emitters;

VII. Malfunctioning of one emitter can be readily detected in the control feedback and corrected for in the algorithm. This is difficult to detect in a total "duty cycle" system in which all of the emitters in each and every row are subject to the "duty cycle" operation;

VIII. Malfunctioning of one solenoid is detected by a reed switch or feedback loop to be more fully described. A message to the operator and a defeat action for the malfunctioning emitter is instituted at the cathode ray tube display to be more fully described.

Using the above approach it is possible to control each emitter temperature very precisely. Instead of having only five steps of control (from all four emitter "on" to all four emitters "off") for each segment there are $4\times6=24$ operating levels in one preferred embodiment but if desired there could be 120 operating levels.

In the case of Segment 1 where all of the four emitters shown in FIG. 1(*a*) are already in high fire, it is possible to start reduction of the overall energy level by decreasing the current pulse, for example, of the emitter unit 12 of the Segment 1 emitter in Row 4 from the condition in which the emitter is operated at high flame for the entire duty cycle (i.e. six seconds) to operation of the aforesaid emitter unit so that it remains at high flame for the first five seconds and is turned off for the final one second interval of the duty cycle. This results in a decrease of 1/24th of the entire energy input from the dryer units in that particular segment or a reduction of approximately four percent. Reducing the energy level one more small step would mean that the emitter unit in Row 4 will now be operated at high flame for the first four seconds of the duty cycle and then operated at low flame for the remaining two seconds of the duty cycle. The emitter unit in Row 4 may further have its energy output reduced in four percent increments by reducing the "on" time period to three seconds which would then correspond to a fifty percent reduction of the energy normally supplied by the emitter unit in row one of segment one.

To reduce the total energy output to seventy-five percent of full drying capacity, the emitter unit in Row 4 of Segment 1 is maintained at low flame during the entire six seconds of the duty cycle. In order to reduce the duty cycle to the next incremental level, the emitter in Row 4 in Segment 1 is maintained at low flame throughout the entire duty cycle while the emitter in Row 3 of Segment 1 is maintained at high flame during only the first five seconds of the duty cycle. The emitters in Rows 1 and 2 of Segment 1 are both maintained at high flame throughout the entire six seconds of the duty cycle.

It can clearly be seen that the arrangement just described provides a very precise temperature control and also yields very high repeatability as well as providing a very uniform distribution across the machine. The thermal inertia of the emitter plates employed in the emitters is such that the surface temperature is held to a tolerance of plus or minus one degree centigrade ($\pm1°$ C.) variation as a result of using the on/off duty cycle technique, provided that the total time cycle is sufficiently short in length. A duty cycle of five to ten seconds achieves this result.

Reviewing the advantages of the fractional approach:

I. The energy savings approximate twenty percent because the energy efficiency is much higher when an emitter is always operating in full fire.

II. Adjusting the air/gas mixture to operate the emitter at 1100° C. optimizes the moisture seeking capability i.e. the amount of energy absorbed with the radiant energy at the wavelength of 1.93 microns is directly proportional to the moisture level on the paper. Thus any of the high frequency moisture variations which are occuring too fast in the paper making process to be detected and much less controlled for, can be automatically leveled by the use of the 1.93 micron emission wave length.

III. The uniformity of the energy distribution across each emitter unit is always the same since the temperature for each segment is the same except for the one segment which is operating in the duty cycle.

Figure 3:
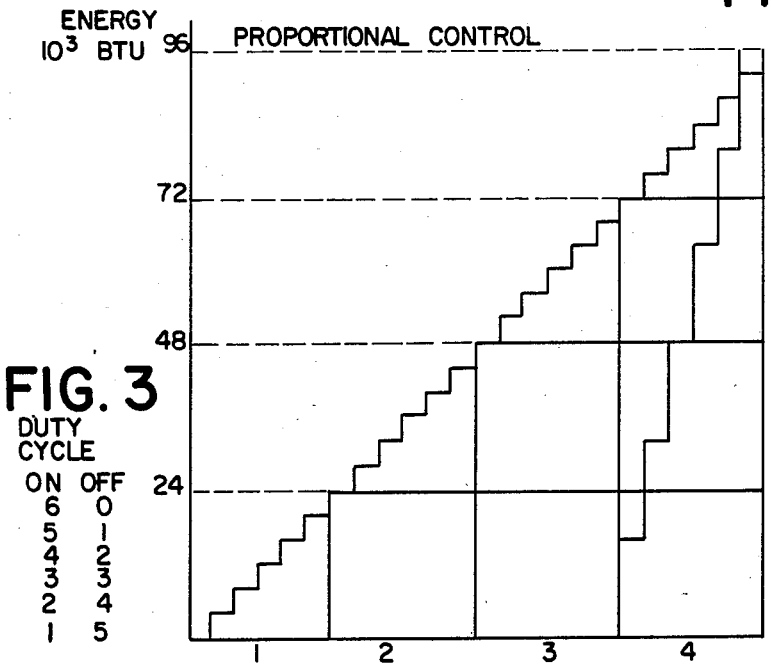
FIG. 3 is a waveform diagram comparing the system of the present invention with a duty cycle obtained through conventional apparatus.

IV. Absorption of energy throughout the thickness of the paper is much greater and significantly more uniform as a result of the use of the higher temperature and higher frequency (i.e. lower wave length)

radiation. This minimizes the wet core in the paper, reduces the overheating of the surface which causes case hardening, reduces the tendency of the paper to curl, and increases the relative vapor pressure in the center of the paper which makes the internal moisture migrate towards the surface where it can be most easily removed by conventional dryers. FIG. 3 shows a proportional control distribution for the four-by-four matrix of FIG. 1(*a*) in which the energy increments, measured in thousands of BTUS, is plotted against the number of emitter units maintained at high flame.

FIG. 6 shows a control system 40 of the present invention. The web moves through the inlet and outlet openings 42(*a*), 42(*b*) of a station 42 for taking on-line moisture measurements employing a scanner 42 which is utilized to determine the moisture content of the web. Scanner 44 may, for example, be any suitable scanner capable of scanning in the cross direction acros web W i.e. in a direction perpendicular to the plane of FIG. 6 and using any conventional technique for obtaining moisture content such as for example the sensor apparatus described in U.S. Pat. No. 3,458,808 issued July 12, 1969 or U.S. Pat. No. 3,829,754 issued Aug. 13, 1974 which disclose moisture detection devices utilizing microwave detection cavities. It should be understood however that any other type of moisture detection device may be utilized, including manual observation.

The scanner 44 preferably scans across the web providing a moisture content signal for each point as the scanner moves across the web, i.e. in the cross direction.

The moisture content output signals are applied to computer 46 under control of a operator station 48. The operator station 48 provides input controls (including basis weight and moisture set points) and which function to operate the computer (which outputs corrected moisture scan data).

The output signals from scanner 44 are transferred from computer 46 through a communications link 50 forming part of automatic system apparatus 48. The communications link may, for example, be a conventional RS232 link, or the like.

The moisture content data transferred to system 48 are coupled to the profile processing circuitry 52.

The output of profile processing circuit 52 is coupled to the cross direction algorithm processing circuit 54 which receives the target profile at input 54(*a*).

The control parameter circuit 60 receives setup conditions and tuning conditions at inputs 60(*a*) and 60(*b*) respectively.

The CD (cross-direction) control algorithms prepare the input profile information against the target profile and control parameters to provide a target energy profile which is coupled through circuit 56 and communication link 58 to the microcomputer 68 of the emitter control system 62 which includes a keypad 66 for keying information into microcomputer 68; the videodisplay 64 for displaying data; an I/O rack for coupling signals between microcomputer 68 and dryer console 72; dryer console 72 which couples control signals to the emitters designated 74 in FIG. 6 and for coupling signals of sensors and the like to computer 68 through I/O rack 70.

Based upon the deviation between the measured moisture content of each longitudinal section of the web W associated with the emitters of each segment and the desired and/or target profile, the emitters of each segment are controlled to provide the desired drying energy for bringing the associated longitudinal section of the web down to the desired moisture content.

As has previously been described in the above-mentioned issued U.S. Pat. No. 4,498,864 the final moisture profile after profiling provides an average moisture content which is equal to the target profile. For example, FIG. 5(*b*) of the aforementioned U.S. Patent shows the moisture profile before profiling with moisture content as high as six percent and as low as 2.25 percent measured in the cross web direction. FIG. 5(*d*) shows the result after profiling with the highest moisture content being 4.3 percent and the lowest moisture content being 3.6 percent and the average moisture content in the cross web direction being four percent (the target profile).

Thus, to correct the moisture profile, the system is typically initialized by having the emitters of Rows 1 and 2 at low flame and the emitters of Rows 3 and 4 at high flame. The system selectively turns "on" those emitters in the moist regions and turns "off" the corresponding number of emitters in those regions which are already over-dryed. A noteworthy effect is that the dryer system is reset to level the profile but the total amount of energy used is only of the order of 50% of the total capacity of the dryer. It is thus possible through a reduction in the amount of drying energy applied to the web to increase, as opposed to decreasing, the average moisture content in the cross web direction.

The keypad 66 may include an increase and a decrease key for each emitter unit segment as well as a group of numeric keys for selecting the desired percentage of drying from 0% through 100% of drying capacity. The video display may present the moisture profile in the form of a bar graph similar for example to that shown in FIG. 5(*b*) of U.S. Pat. No. 4,498,864. Or for example, the display may be a LED display showing the moisture content for each section of the web as a deviation from an average or desired value, for example.

Considering the system of FIG. 6 in greater detail:

The operator's station 48 and computer 46 utilized in conjunction with scanner 44 constitute standard equipment presently available in the marketplace and sold for example by AccuRay, Measurex and Sentrol, for example.

The scanner is moved in the cross-direction i.e. transverse to the direction of movement of the web, typically to as the machine direction and the moisture values obtained are related not only to locations in the cross direction but locations in the machine direction as well (due to the movement of the web during scanning). Computer 46 associates each moisture measurement with a cross-direction location and a machine direction location. This data is transmitted through a communication link which may, for example, be as RS 232 link. The data, for example, is transmitted in either eight or sixteen bit bytes.

The automatic system may, for example, be comprised of a Model 8088/8087 microprocessor which is available from a number of different manufacturers including Intel, Motorola, etc.

These two units operate under control of a software program whose general program flow steps are shown in FIG. 6.

Upon receipt of the moisture information, wherein each moisture reading is associated with a machine direction and cross-direction location, profile processing is accomplished at stage 52 which filters and spatially adjusts the data in a regular matrix corresponding in a one-to-one relationship with each of the associated emitters arranged in a matrix fashion as shown for example in FIG. 1(*a*). Thus, for example, the moisture readings whose cross-direction and web direction coordinates are associated with one longitudinal section of the web are averaged.

The cross-direction control algorithm receives the target profile inputted at 54(*a*) which represents the desired moisture profile and which is preset into the computer. The moisture profile may be a straight line, a "frown" i.e. generally inverted U-shaped curve, or a "smile", i.e. an upright substantially U-shaped curve, depending upon the result desired. The actual moisture readings for each longitudinal section of the web are compared against the target profile for that section of the web and the differences therebetween are determined by a subtractive operation. For example, the target profile for each cross-direction position is compared against an actual (filtered) moisture measurement. More specifically, assuming that the actual moisture measurement is 4% and the target profile value for the related cross-direction location is 4.5%, the difference value of 0.5% is obtained. These values are utilized in a P.I.D., i.e. proportional integral derivative control algorithm which constitutes a model of the process. The drying energy required from each of the emitters for correcting the moisture content at the associated cross-direction location are determined. For example, assuming that the cross-direction locations have been determined, which, as mentioned here and above and which deviates by 0.5% from the target profile occurs in that part of the web which is associated with the emitter in Rows 1 through 4 in Segment 1, a determination is made as to which of the three emitters operated under direct control should be operated at either full flame or low flame and finally what duty cycle arrangement should be utilized for the appropriate emitter in Segment 1 in order to generate the amount of infrared radiation necessary to reduce the moisture in that region of the web by a value of 0.5% down to the target profile. These settings are determined from that fraction of the total drying capacity of the emitter units in Segment 1 required to reduce moisture content obtained when operating at full drying capacity which is a known, predetermined value. The percent reduction in moisture content desired between 0% and the maximum percent reduction in moisture content determines the number of emitters to operate a high flame. For example, assuming that maximum drying capacity will provide a reduction of 2%, if a reduction of 0.5% in moisture content is desired, the emitters will be operated at 25% of full drying capacity, i.e. one emitter at high flame and the remaining three emitters at low flame.

This data is available at the target energy profile step 56 and is communicated to the microcomputer 68 forming part of the operator console unit 62 through communications link 58 which may be of the type which may be substantially identical to that described for the communications link 50, such as an PS232 link. Thus, the data is transmitted to microcomputer 68 and is thereafter made available to microcomputer 68 in parallel form for appropriate processing. The video display 64, keypad 66 and microcomputer 68, as well as the I/O racks 70 are of standard design. The video display 64 provides a display of moisture content of each longitudinal portion of the moving web. Keypad 66 comprises at least a pair of keys for making an upward and downward direction and a keypad of numeric keys and a decimal point key for inputting the magnitude of the correction required to be made in addition to automatic corrections which are continuously updated and attended to by the automatic system 48.

The microcomputer 68 converts the energy profile data for the fixed area (i.e. emitters) of the square matrix into digital values representing the desired movement of the control valves for each area (i.e. emitter) of the matrix region.

Each of these digital signals are converted by individual digital to analog converter circuits of the I/O rack 70 into electrical signals of the proper magnitude for controlling the needle valves, for example shown in FIGS. 7 through 7(*c*) of the aforementioned U.S. Pat. No. 4,498,864.

These control voltages are applied to each individual emitter in the emitter group 74 through the dryer console 72 whereupon each of the emitters are caused to operate at the appropriate low or full flame condition necessary to obtain the desired correction in moisture content commensurate with the target profile. It should be noted that the present invention maintains the maximum optimum number of emitters at full flame to achieve optimum drying capability per unit of fuel consumption thus significantly enhancing the fuel efficiency of the system as well as optimizing and maximizing the drying capability of the system and also providing fine adjustments not heretofore possible through the use of prior art systems.

The automatic adjustment of the target energy profile is continuously updated depending upon changes detected by the scanner thus assuring that any changes in moisture content of the web are continuously taken into acount to provide the proper adjustment.

FIGS. 7 through 7(*b*) show a system in which the emitters of alternating rows are staggered relative to the emitters of intervening rows. Since each particular emitter segment is practically limited to a width of the order of six inches whereas moisture streaks which appear in the paper may be much narrower than six inches, it is possible to more accurately reduce moisture content for moisture streaks not capable of being handled by the embodiment of FIG. 1(*a*) and also handle wider streaks that are subject to a phase shift relative to the orientation of the standard six inch emitters by the emitter arrangement shown in FIGS. 7 through 7(*c*). Emitters 12 in Rows 2 and 4 are staggered relative to the emitters 12' in Rows 1 and 3. Noting, for example FIG. 7(*a*), emitters 12 are arranged relative to emitter 12' so that the central axis A' of the emitter 12' is colinear with the engaging edges of adjacent emitters 12.

The emitters of Rows 2 and 4, for example, are arranged to provide a moisture variation as shown by waveform M2 where the moisture peaks are centered on the midpoint of each emitter module whereas the emitters arranged in Rows 2 and 4 provide a moisture variation represented by waveform M1 whose moisture variations fall in the wrong location in order to be adequately corrected by the emitters of Row 1. In that case, the emitters of Row 2 can therefore be used to accurately correct the moisture profile not capable of being corrected by the emitters of Row 1.

The three inch offset on alternate rows of emitters provide capabilities to handle the phase shift in the moisture variation as well as a narrower moisture streak than is capable of being corrected using conventional row orientation shown for example in FIG. 1(*a*). The mathematical algorithm required in order to achieve the optimal energy level selection for each one of the segments is slightly more complicated using the off-set technique. However, the mathematical approach is to achieve a significant reduction in the variation of moisture across the web has been incorporated in the present invention to yield the desired results. For example, the emitters of alternating rows and arranged in the same column may be utilized to dry an associated longitudinal portion of the web independently of the emitters in interspersed rows which partially overlap the aforesaid column.

Alternatively a combination of the emitters in the column and partially overlapping the column may be utilized to obtain the desired level of drying.

The drying technique considered in more detail is comprised of operating emitters in staggered rows whereby the cumulative drying effect is to provide peak drying between the midpoints of the staggered emitters 12' and the interspersed emitters 12 such as are shown in FIG. 7(*a*).

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein. For example, the time increments of the duty cycle may be non-uniform in order to obtain linear changes in drying increments. The intervals may be as short as 0.2 seconds and as long as 1.8 seconds during the same duty cycle, the average value being approximately one second.

What is claimed is:

1. A method of drying a moving web to control the amount of moisture in the web by comprising the steps of:

arranging a plurality of dryer units in a regular matrix of rows and columns so that the dryer units in each row are arranged parallel to one another, each row being transverse to the direction of movement of the web and so that the dryer units in each column are parallel to the other columns and parallel to the direction of movement of the web, each column of dryer units being arranged to dry an associated longitudinal portion of the web;

adjusting the moisture content in each longitudinal portion of the web by adjusting the dryer units associated with the aforesaid longitudinal portion so that selected ones of the dryer units are operated at either a high flame condition or a low flame condition according to the amount of drying desired, said low flame condition being sufficient to sustain combustion of the fuel supplied to the dryer units while providing an insignificant amount of drying and the high flame condition being sufficient to provide a significant measureable amount of drying;

operating at least one and less than all of the dryer units in said column according to a predetermined duty cycle of a preselected interval such that the amount of time that the last mentioned dryer unit is maintained at the high flame condition during said interval is a function of the desired amount of drying, the last mentioned dryer unit being maintained at the low flame condition during the remainder of the duty cycle interval.

2. The method of claim 1 wherein the duty cycle operation selected is continuously repeated during the drying operation to obtain the desired moisture content.

3. The method of claim 1 wherein the duty cycle is comprised of a preselected number of individual time increments and the desired amount of drying is obtained by maintaining the dryer unit operated according to said duty cycle at the high flame condition during said number of said time increments.

4. The method of claim 3 wherein said time increments are between 0.2 and 1.0 seconds.

5. The method of claim 4 wherein said time increments are preferably one second.

6. The method of claim 4 wherein there are n time increments in each duty cycle where n is a real integer greater than one.

7. The method of claim 6 wherein n is preferably in the range from two (2) to ten (10) seconds.

8. The method of claim 1 wherein the method further includes the steps of operating the dryer units in each column so that the maximum number of dryer units in each column are operated at the high flame condition commensurate with the desired moisture content of the portion of the web being dried by said column of dryer units.

9. The method of claim 1 further comprising the step of adjusting the high flame condition so that the drying capability of the drying unit is maximised.

10. The method of claim 9 wherein each of said dryer units is an infrared emitter and the high flame condition is adjusted so that the wavelength of the infrared radiation generated by the infrared emitter at the high flame condition is in the range from 1.85 to 2.05 microns.

11. The method of claim 10 wherein said preferred wave length range is between 1.88 and 1.95 microns.

12. Apparatus for controlling the moisture content of a moving web comprising:

a plurality of dryer units arranged in a regular matrix of rows and columns, the units in each row being parallel to the other rows and transverse to the direction of movement of the web, the units in each column being parallel to the other columns and parallel to the direction of movement of the web;

each column of units being arranged to dry an associated longitudinal portion of the web;

each dryer unit having a fuel mixing control valve operable at either a low flame or high flame condition, said low flame condition being sufficient to sustain combustion while providing insignificant drying and said high flame condition providing a significant, measureable amount of drying;

means for controlling the control valves of at least one and less than all of said dryer units in selected rows of said matrix to operate at one of said low and high flame conditions according to the moisture level desired in said web;

said controlling means further comprising means for controlling the control valves of at least one of the dryer units in each of said rows to operate according to a duty cycle of a predetermined time interval, said valves being controlled to operate at the high flame condition for a predetermined portion of the duty cycle according to the moisture level desired for the longitudinal portion of the web associated with the dryer unit being so controlled, said duty cycle operation being continuously repeated during the drying operation.

13. The apparatus of claim 12 wherein said dryer units are emitters designed to emit radiation energy in the infrared range.

14. The apparatus of claim 13 wherein the high flame condition causes the emitter to emit infrared rediation centered on the wavelength range from 1.85 to 2.05 microns.

15. The apparatus of claim 14 wherein the preferred wavelength range is between 1.88 and 1.95 microns.

16. The apparatus of claim 12 further comprising:

scanning means for scanning the web to provide a moisture content profile across said web;

means for selecting the desired moisture content across said web;

said control means comparing the measured moisture content value against the desired moisture content value for each longitudinal portion of the web for determining the control valve settings and the duty cycle for the dryer units in each column of said matrix.

17. The apparatus of claim 12 wherrein additional rows of emitters are interspersed with the first mentioned rows so that the emitters in said additional rows are staggered relative to the emitters in the remaining rows wherein the longitudinal axes of emitters in the interspersed rows are displaced from longitudinal axes of emitters in the remaining rows enabling drying of narrower longitudinal streaks of the web than is obtainable when the non-staggered emitters of the rows of the matrix are staggered.

* * * * *